US008275293B2

(12) United States Patent
Ono

(10) Patent No.: US 8,275,293 B2
(45) Date of Patent: Sep. 25, 2012

(54) CONDUCTIVE MEMBER, CHARGING DEVICE, PROCESS CARTRIDGE, AND IMAGE FORMING DEVICE

(75) Inventor: Keiko Ono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 12/723,025

(22) Filed: Mar. 12, 2010

(65) Prior Publication Data

US 2011/0013939 A1 Jan. 20, 2011

(30) Foreign Application Priority Data

Jul. 16, 2009 (JP) ..... 2009-168005

(51) Int. Cl.
*G03G 15/02* (2006.01)

(52) U.S. Cl. ..... 399/176

(58) Field of Classification Search ..... 399/174, 399/313, 176, 302, 308; 492/53, 56; 361/225
See application file for complete search history.

(56) References Cited

U.S. PATENT DOCUMENTS

| | | | | | |
|---|---|---|---|---|---|
| 5,140,371 | A * | 8/1992 | Ishihara et al. | ..... | 399/176 |
| 5,978,639 | A * | 11/1999 | Masuda et al. | ..... | 399/302 |
| 6,044,243 | A * | 3/2000 | Hara | ..... | 399/302 |
| 6,123,755 | A * | 9/2000 | Yamamori et al. | ..... | 106/15.05 |
| 6,810,225 | B2 * | 10/2004 | Kitano et al. | ..... | 399/176 |
| 7,008,991 | B2 * | 3/2006 | Takagi et al. | ..... | 524/496 |

FOREIGN PATENT DOCUMENTS

| | | | |
|---|---|---|---|
| JP | 02113068 | A * | 4/1990 |
| JP | A-8-137186 | | 5/1996 |
| JP | 10254215 | A * | 9/1998 |
| JP | A-2004-210828 | | 7/2004 |
| JP | 2009122592 | A * | 6/2009 |

OTHER PUBLICATIONS

Brandrup et al.; *Polymer Handbook*; Feb. 22, 1999; pp. 675, 680-683 and pp. 702-711; Fourth Edition; John Wiley & Sons, Inc.

* cited by examiner

*Primary Examiner* — Robert Beatty
(74) *Attorney, Agent, or Firm* — Oliff & Berridge, PLC

(57) ABSTRACT

A conductive member includes a substrate, an elastic layer provided on the substrate and a surface layer provided on the elastic layer, in which the surface layer has a sea/island structure includes a sea portion containing a first resin and an island portion containing a second resin, and at least the island portion contains carbon black.

16 Claims, 6 Drawing Sheets

CONDUCTIVE MEMBER, CHARGING DEVICE, PROCESS CARTRIDGE, AND IMAGE FORMING DEVICE

CROSS-REFERENCE TO RELATED APPLICATION

This application is based on and claims priority under 35 USC 119 from Japanese Patent Application No. 2009-168005 filed on Jul. 16, 2009.

BACKGROUND

1. Technical Field

The present invention relates to a conductive member, a charging device, a process cartridge, and an image forming device.

2. Related Art

In recent years, image forming devices such as printers or copying machines have come into widespread use, and technologies for various elements constituting the image forming devices have also become widespread. In an image forming device using an electrophotographic system, a photoreceptor such as a photoreceptor drum (image holding member) is charged using a charging device, and an electrostatic latent image that has a different potential from the surrounding potential is formed on the charged photoreceptor, thereby forming a pattern to be printed. Subsequently, the electrostatic latent image is developed using a toner and transferred onto a recording medium such as a recording paper.

SUMMARY

According to an aspect of the invention, there is provided a conductive member, the conductive member including a substrate, an elastic layer provided on the substrate and a surface layer provided on the elastic layer, the surface layer having a sea/island structure including a sea portion containing a first resin and an island portion containing a second resin, and at least the island portion containing carbon black.

BRIEF DESCRIPTION OF THE DRAWINGS

Exemplary embodiments of the present invention will be described in detail based on the following Figures, wherein.

DETAILED DESCRIPTION

Hereinafter, an exemplary embodiment as an example of the present invention is described with reference to the drawings.

Conductive Member

Figure 1:
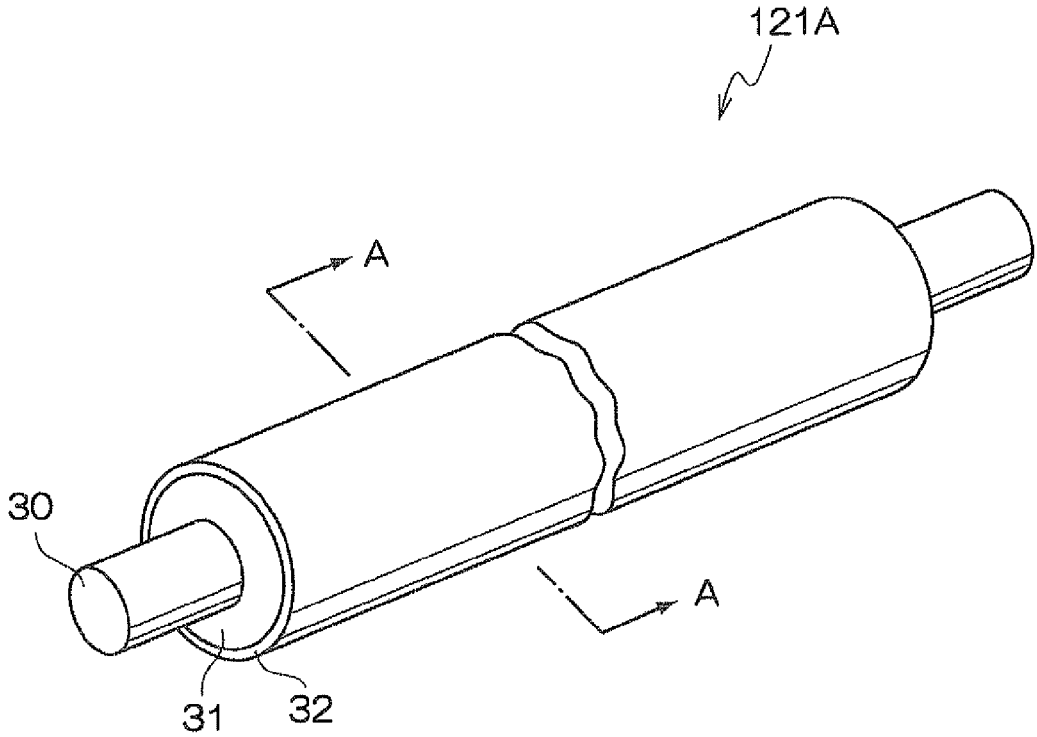
FIG. 1 is a schematic perspective view showing a charging member according to an exemplary embodiment of the present invention.
Figure 2:
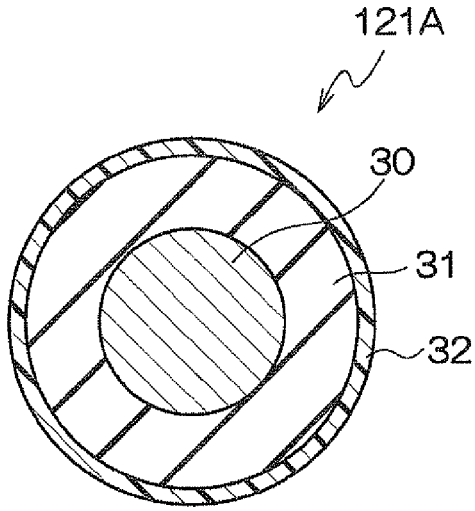
FIG. 2 is a schematic cross sectional view of the charging member according to the exemplary embodiment of the present invention.
Figure 3:
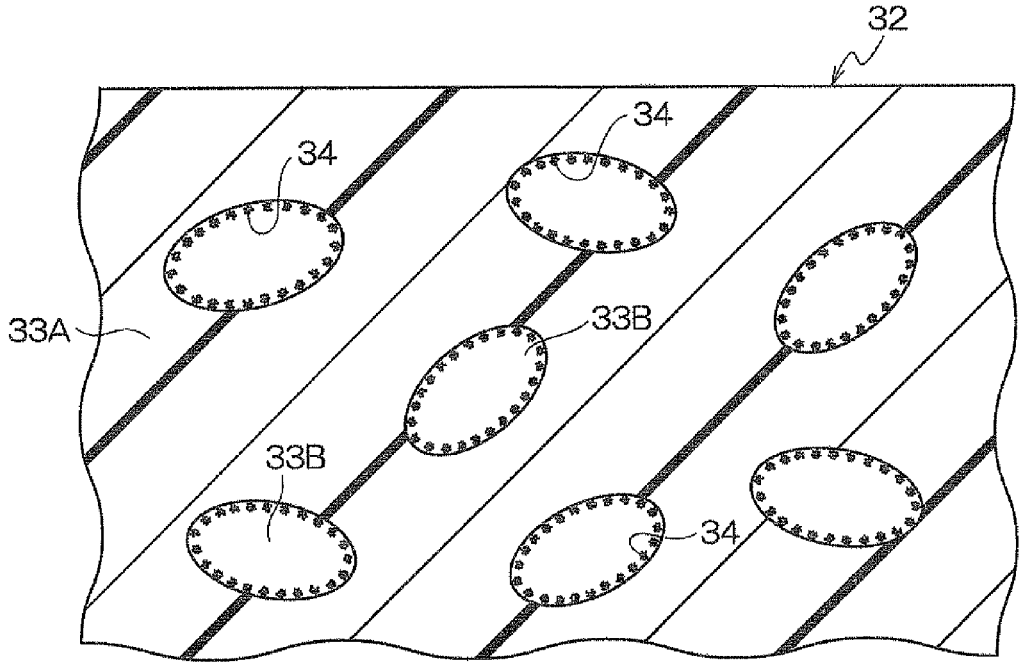
FIG. 3 is an enlarged cross sectional view showing a surface layer in the charging member according to the exemplary embodiment of the present invention.

FIG. 1 is a schematic perspective view showing a charging member according to the present exemplary embodiment. FIG. 2 is a schematic cross sectional view of the charging member according to the present exemplary embodiment. FIG. 3 is an enlarged cross sectional view showing a surface layer in the charging member according to the present exemplary embodiment. Here, FIG. 2 is a cross sectional view along the line A-A in FIG. 1.

For example, as shown in FIGS. 1 and 2, a conductive member 121A according to the present exemplary embodiment is a roll member containing a shaft 30 (an example of a substrate), an elastic layer 31 provided on the outer peripheral surface of the shaft 30, and a surface layer 32 provided on the outer peripheral surface of the elastic layer 31.

As shown in FIG. 3, the surface layer 32 has a sea/island structure including a sea portion 33A containing a first resin and an island portion 33B containing a second resin, and at least the island portion 33B contains carbon black 34.

The conductive member 121A according to the present exemplary embodiment is not limited to the above-described structure. For example, the conductive member 121A may contain an adhesive layer (primer layer) provided between the elastic layer 31 and the shaft 30, a resistance-controlling layer provided between the elastic layer 31 and the surface layer 32, or a coating layer (protective layer) provided on the outside (outermost surface) of the surface layer 32.

Hereinafter, the conductive member 121A according to the present exemplary embodiment is described as a roll member, but the shape of the conductive member is not limited thereto. The conductive member 121A may be an endless belt member or a sheet member, for example.

Hereinafter, each member of the conductive member 121A according to the present exemplary embodiment is described.

Shaft

The shaft 30 is a conductive rod-like member. Example of materials thereof include metals such as iron (free cutting steel or the like), copper, brass, stainless steel, aluminum, or nickel. Specific examples of the shaft 30 include a member (for example, a resin member or a ceramic member) whose outer peripheral surface has been plated; and a member (for example, a resin member or a ceramic member) in which a conductive agent has been dispersed. The shaft 30 may be a hollow member (tubular member) or a non-hollow member. Here, the "conductivity" means that the volume resistivity is lower than $10^{13}$ Ωcm.

Elastic Layer

The elastic layer 31 contains, for example, an elastic material and a conductive agent, and optionally, contains other additives as necessary.

Examples of the elastic material include isoprene rubber, chloroprene rubber, epichlorohydrin rubber, butyl rubber, polyurethane, silicone rubber, fluoro rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR) and natural rubbers, and rubber blends thereof. Among these, polyurethane, silicone rubber, EPDM, epichlorohydrin-ethylene oxide copolymer rubber, epichlorohydrin-ethylene oxide-allyl glycidyl ether copolymer rubber and NBR, and rubber blends thereof are preferable. The elastic material may be a foam material or a non-forming material.

Examples of the conductive agent include an electroconductive agent or an ionic conductive agent. Examples of the electroconductive agent include powder such as carbon black (for example, Ketjen black and Acetylene black); thermal decomposition carbon or graphite; various conductive metals or alloys (for example, aluminum, copper, nickel and stainless steel); various conductive metal oxides (for example, tin oxide, indium oxide, titanium oxide, tin oxide-antimony oxide solid solution and tin oxide-indium oxide solid solution); or an insulating substance whose surface has been subjected to conducting treatment. Examples of the ionic conductive agent include perchlorates and chlorates of tetraethylammonium or lauryl trimethyl ammonium; and perchlorates and chlorates of alkaline metals or alkaline earth metals such as lithium or magnesium. These conductive agents may be used singly or in combination of two or more kinds thereof.

Here, specific examples of the carbon black include SPECIAL BLACK 350, SPECIAL BLACK 100, SPECIAL BLACK 250, SPECIAL BLACK 5, SPECIAL BLACK 4, SPECIAL BLACK 4A, SPECIAL BLACK 550, SPECIAL BLACK 6, COLOR BLACK FW200, COLOR BLACK FW2 and COLOR BLACK FW2V (all trade names; manufactured by Degussa), and MONARCH 1000, MONARCH 1300, MONARCH 1400, MOGUL-L and REGAL 400R (all trade names; manufactured by Cabot Corporation).

The addition amount of the conductive agent is not particularly limited. When the above-described electroconductive agent is used, the addition amount thereof is preferably in the range of from 1 part by weight to 30 parts by weight, and more preferably in the range of from 15 parts by weight to 25 parts by weight, with respect to 100 parts by weight of the elastic material. When the above-described ionic conductive agent is used, the addition amount thereof is preferably in the range of from 0.1 parts by weight to 5.0 parts by weight, and more preferably in the range of from 0.5 parts by weight to 3.0 parts by weight, with respect to 100 parts by weight of the elastic material.

Examples of the additives that may be added in the elastic layer 31 include materials that can be generally added in the elastic layer, such as a softener, a plasticizer, a curing agent, a vulcanizing agent, a vulcanization accelerator, an antioxidant, a surfactant, a coupling agent, or a filler (for example, silica or calcium carbonate).

The average film thickness of the elastic layer 31 is preferably from about 1 mm to about 10 mm, and more preferably from about 2 mm to about 5 mm. The volume resistivity of the elastic layer is preferably from $10^3$ Ωcm to $10^{14}$ Ωcm.

Surface Layer

As shown in FIG. 3, the surface layer 32 has a sea/island structure including a sea portion 33A containing a first resin and an island portion 33B containing a second resin, and at least the island portion 33B contains carbon black 34.

In the sea/island structure, the diameter of the island portion 33B is preferably from 100 nm to 500 nm (or about 100 nm to about 500 nm), and more preferably from 150 nm to 400 nm (or about 150 nm to about 400 nm). When the diameter of the island portion 33B is within the above range, an island portion 33B that includes an appropriately-sized aggregate of carbon black may be easily obtained, and electrical discharge with reduced current, in which uneven discharge is suppressed, may be obtained in the conductive member 121A.

The diameter of the island portion is an average value of values obtained by conducting the following process for 10 portions: preparing a sample (section) of the surface layer 32 using a cryomicrotome, observing the sample under a transmission electron microscope (TEM), and measuring the maximum diameter of the island portion 33B.

Here, the "sea/island structure" refers to a structure in which at least two resins (the first resin and the second resin) are mixed in an incompatible state. That is, in the "sea/island structure", a continuous phase containing the first resin is defined as the sea portion 33A, and a discontinuous phase that contains the second resin and is suspended in the sea portion 33A is defined as the island portion 33B.

The sea/island structure can be formed by controlling a ratio of solubility parameter (SP value) of the first resin to that of the second resin (a ratio of an SP value of the first resin constituting the sea portion 33A to an SP value of the second resin constituting the island portion 33B), and/or a mixing ratio of the first resin and the second resin. When a ratio of an SP value of the first resin to an SP value of the second resin is large, the sea/island structure may easily be formed.

Specifically, the difference of an SP value of the first resin and an SP value of the second resin is preferably from 2 to 10 (or from about 2 to about 10). When the difference of SP values is within the above range, the sea/island structure may easily be formed.

The mixing ratio (weight ratio) of the first resin to the second resin (first resin/second resin) is preferably from 98/2 to 75/25, and preferably from 95/5 to 85/15. When the mixing ratio is within the above range, a sea/island structure having an island portion with an appropriate size (for example, an island portion having a diameter of the above-described range) may easily be formed.

Here, a method described in "Polymer Handbook, 4th edition, John Wiley & Sons" VII, p 680-683, is used as the calculation method for the solubility parameter (SP value). The solubility parameter (SP value) is defined as the square root of cohesive energy density (evaporation energy of one molecule per unit area), and represents the degree of polarity per unit volume.

For a resin, the solubility parameter (SP value) is generally calculated using the following equation (Small's equation).

Equation $$SP(cal/cm^3)^{1/2}=d\Sigma G/M$$

In the equation, M represents the molecular weight of a polymer per unit; d represents density; and G represents a constant value specific to an atomic group or a substituent.

The solubility parameters of typical resins are described in "Polymer Handbook", 4th edition, John Wiley & Sons, Vol. VII, pp. 702-711. A value obtained by substituting the cohesive energy constant of Hoy for Small's equation may be applied as the solubility parameter.

In order to incorporate the carbon black 34 in the island portion 33B, for example, a resin in which the carbon black 34 is not easily dispersed and a resin in which the carbon black 34 can be dispersed easily may be selected as the first resin constituting the sea portion 33A and the second resin constituting the island portion 33B, respectively.

Examples of the first resin constituting the sea portion include an acrylic resin, a cellulose resin, a polyamide resin, a copolymerized nylon, a polyurethane resin, a polycarbonate resin, a polyester resin, a polyethylene resin, a polyvinyl resin, a polyarylate resin, a styrene butadiene resin, a melamine resin, an epoxy resin, a urethane resin, a silicone resin, a fluoro resin (for example, a tetrafluoroethylene/perfluoro (alkyl vinyl ether) copolymer, a tetrafluoroethylene-hexafluoropropylene copolymer, and polyvinylidene fluoride), and a urea resin. Here, the copolymerized nylon may be a copolymerized nylon that has at least one polymerization unit selected from the group consisting of nylon 610, nylon 11 and nylon 12. The copolymerized nylon may include another polymerization unit such as nylon 6 or nylon 66. The elastic material to be blended in the elastic layer 31 may be used as the first resin.

As the first resin, two or more kinds of resins may be used in combination.

Examples of the second resin constituting the island portion 33B include a polyvinylbutyral resin (PVB), a polystyrene resin and a polyvinyl alcohol resin.

Examples of the carbon black (34) include Ketjen black, acetylene black, and oxidation treated carbon black having a pH of 5 or lower. Specific examples of the carbon black include PRINTEX 150, SPECIAL BLACK 350, SPECIAL BLACK 100, SPECIAL BLACK 250, SPECIAL BLACK 5, SPECIAL BLACK 4, SPECIAL BLACK 4A, SPECIAL BLACK 550, SPECIAL BLACK 6, COLOR BLACK FW200, COLOR BLACK FW2 and COLOR BLACK FW2V (all trade names; manufactured by Degussa); and MONARCH 880, MONARCH 1000, MONARCH 1300, MONARCH 1400, MOGUL-L and REGAL 400R (all trade names; manufactured by Cabot Corporation).

The DBP oil absorption amount of the carbon black 34 is preferably from 80 cc/100 g to 160 cc/100 g, and more preferably 90 cc/100 g to 120 cc/100 g. When the DBP oil absorption amount thereof is within the above range, an island portion 33B that includes an appropriately-sized aggregate of carbon black (for example, an aggregate having an average particle diameter of the below-described range) may be easily obtained, and electrical discharge with reduced current, in which uneven discharge is suppressed, may be obtained in the conductive member 121A.

The DBP oil absorption amount (cc/100 g) is a value which is defined by ASTM (American Standard Test Method) D2414-6TT, and indicates the amount of dibutyl phthalate (DBP) absorbed in 100 g of carbon black.

It is preferable that, in the island portion 33B, the carbon black 34 is unevenly distributed with a higher concentration at the side of the interface between the island portion 33B and the sea portion 33A. As a result, an island portion 33B that includes an appropriately-size aggregate of carbon black may be easily obtained, and electrical discharge with reduced current, in which uneven discharge is suppressed, may be obtained in the member 121A.

Regarding the degree to which distribution is uneven, it is preferable that the ratio (proportion) of an amount of the carbon black 34 included in a region within 50 nm from the interface between the island portion 33B and the sea portion 33A to the total amount of the carbon black 34 included in the island portion 33B is 90% or more.

The proportion of the carbon black that is thus unevenly distributed is an average value of values obtained by conducting the following process for 10 portions: preparing a sample (section) of the surface layer 32 using a cryomicrotome, observing the island portion 33B of the sample under a transmission electron microscope (TEM), and measuring and calculating the area of the carbon black 34 included in the island portion 33B and of the unevenly distributed carbon black 34 included at the side of the interface between the sea portion 33A and the island portion 33B.

The content of the carbon black 34 (the total content of the carbon black included in the surface layer 32) is preferably 10% by weight to 20% by weight, and more preferably from 13% by weight to 16% by weight, with respect to a total weight of the surface layer 32.

Here, it is preferable that the amount (proportion) of the carbon black included in the island portion 33B is 90% or more (or about 90% or more), with respect to a total amount of carbon black included in the surface layer 32. When the content of the carbon black included in the island portion 33B is within the above range, the amount of the carbon black 34 included in the sea portion is reduced, whereby electrical discharge with reduced current, in which uneven discharge is suppressed, may be obtained in the conductive member 121A.

The proportion of the carbon black included in the island portion 33B is an average value of values obtained by conducting the following process for 10 portions: preparing sample (section) of the surface layer 32 using a cryomicrotome, observing a 4 μm×4 μm area of the samples including the sea portion 33A and the island portion 33B under a transmission electron microscope (TEM), and measuring and calculating the area of the carbon black included in each of the sea portion 33A and the island portion 33B.

The average thickness of the surface layer 32 (the average thickness of the total surface layer 32) is preferably from 7 μm to 25 μm. The volume resistivity of the surface layer 32 is preferably from $10^3$ Ωcm to $10^{14}$ Ωcm.

The conductive member 121A according to the present exemplary embodiment may be produced by successively forming the elastic layer 31 and the surface layer 32 on the outer peripheral surface of the shaft 30 using, for example, a blade coating method, a Meyer Bar coating method, a spray coating method, an immersion coating method, a bead coating method, an air knife coating method, a curtain coating method or the like.

The above-described conductive member 121A according to the present exemplary embodiment includes the surface layer 32 having the sea/island structure including the sea portion 33A containing the first resin and the island portion 33B containing the second resin, and at least the island portion 33B contains the carbon black 34. As a result, electrical discharge with reduced current, in which uneven discharge is suppressed, may be obtained, and this effect may be maintained over a long period of time.

The reason for this is not clear but is thought to be as follows. The island portion 33B (a discontinuous phase in the sea/island structure) is dispersed evenly in the sea portion 33A (a continuous phase) with a specified size. Consequently, when the sea/island structure is constituted such that the carbon black 34 is included in this island portion 33B, the carbon black 34 may be included in the surface layer 32 as an appropriately-sized aggregate and evenly distributed in the surface layer 32 together with the island portion 33B. More specifically, due to the sea/island structure of the resin, formation of a large aggregate that can easily function as the starting point of unusual discharge or of primary particles that can easily cause uneven discharge may be suppressed in the carbon black 34 included in the island portion 33B. Further, the size of carbon black 34 included in the island portion 33B may be controlled according to the size of the island portion 33B, and an aggregate of the carbon black 34 having an appropriate size may be evenly dispersed in the surface layer 32. Therefore, in the conductive member 121A having the surface layer 32 in which the carbon black 34 is dispersed in such a state, electrical discharge with reduced current, in which uneven discharge is suppressed, may be obtained, and this effect may be maintained over a long period of time.

The conductive member 121A according to the present exemplary embodiment may be used as a conductive member (such as a charging roller) or a transfer member (such as a transfer roller) in an electrophotographic image forming device.

For example, when the conductive member 121A according to the present exemplary embodiment is used as a charging member, electrical discharge with reduced current, in which uneven discharge is suppressed, may be obtained. In addition, when an image forming device (or a process cartridge) having this charging member is used, an image, in which the occurrence of white deletion caused by uneven charge is suppressed, may be obtained.

Alternatively, when the conductive member 121A according to the present exemplary embodiment is used as a transfer member, transferring with reduced current, in which uneven transferring is suppressed, may be obtained. In addition, when an image forming device (or a process cartridge) having this transfer member is used, an image, in which image defects caused by the uneven transferring is suppressed, may be obtained.

Charging Device

Figure 4:
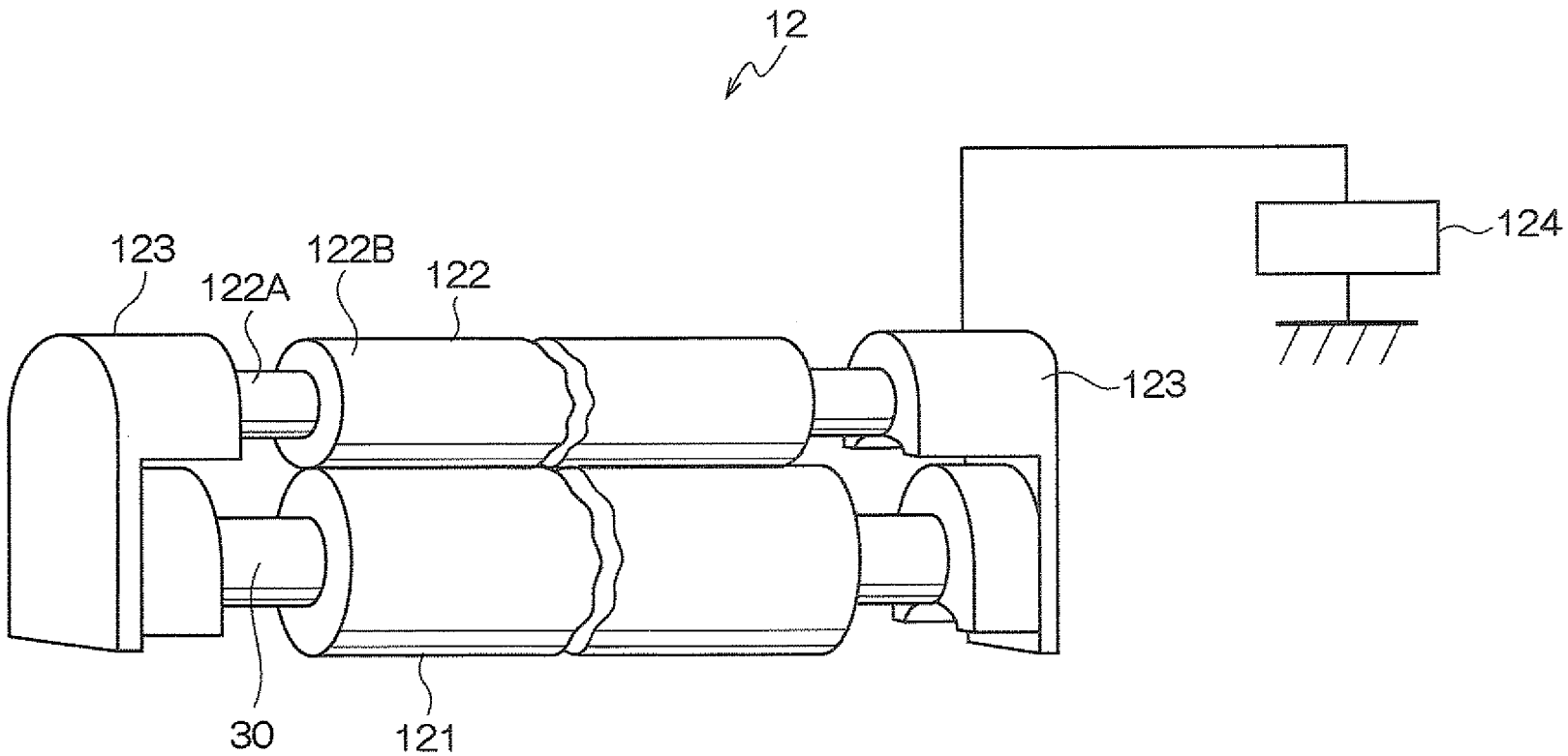
FIG. 4 is a schematic perspective view of a charging device according to the exemplary embodiment of the present invention.

Hereinafter, the charging device according to the present exemplary embodiment is described. FIG. 4 is a schematic perspective view of the charging device according to the present exemplary embodiment. The charging device according to the present exemplary embodiment uses the above-described conductive member according to the present exemplary embodiment as the charging member.

As shown in FIG. 4, in the charging device 12 according to the present exemplary embodiment, the charging member 121 and a cleaning member 122 are disposed such that they come into contact with each other at a specific ratio of engagement. Both of the axial end portions of the shaft 30 of the charging member 121 and a shaft 122A of the cleaning member 122 are held by a conductive bearing 123 such that each member freely rotates. A power supply 124 is connected to one end of the conductive bearing 123. The charging device according to the present exemplary embodiment is not limited to the above-described structure, and, for example, may have a structure in which the cleaning member 122 is not included.

The cleaning member 122 is a cleaning member for cleaning the surface of the charging member 121. The cleaning member 122 may be a roll shape member. For example, the cleaning member 122 includes the shaft 122A and an elastic layer 122B formed on the outer peripheral surface of the shaft 122A.

The shaft 122A is a conductive rod-like member. Examples of the materials thereof include iron (free cutting steel or the like), copper, brass, stainless steel, aluminum and nickel. Specific examples of the shaft 122A include a member (for example, resin members or ceramic members) whose outer peripheral surface has been plated; and a member (for example, a resin member or a ceramic member) in which a conductive agent has been dispersed. The shaft 122A may be a hollow member (tubular member) or a non-hollow member.

It is preferable that the elastic layer 122B has elasticity and is a foam material having a three-dimensional porous structure, which has cavities or a concave and convex portion (hereinafter referred to as a "cell") inside or on the surface thereof. The elastic layer 122B may include a foamed resin material or rubber material such as polyurethane, polyethylene, polyamide, olefin, melamine or polypropylene, NBR (acrylonitrile-butadiene copolymer rubber), EPDM (ethylene-propylene-diene copolymer rubber), natural rubber, styrene-butadiene rubber, chloroprene, silicone or nitrile.

Among these foamed resin materials or rubber materials, polyurethane that has resistance to tearing or extension is particularly preferable, in order to frictionally slide on the charging member 121 and efficiently remove a foreign substance (such as toner or an external additive), in order to prevent the surface of the charging member 121 from being scratched due to rubbing of the cleaning member 122 and in order to prevent the occurrence of tearing or breakage over the long-term.

Examples of the polyurethane include, but not limited to, a material formed by a reaction of a polyol (for example, polyester polyol, polyether polyester or acrylic polyol) with an isocyanate (2,4-tolylenediisocyanate, 2,6-tolylenediisocyanate, 4,4-diphenyl methane diisocyanate, tolidine diisocyanate or 1,6-hexamethylene diisocyanate), and materials formed by a reaction of these reactants with a chain extension agent (for example, 1,4-butanediol or trimethylolpropane). In general, polyurethane is foamed using a foaming agent (for example, water or an azo compound such as azodicarbonamide or azobisisobutyronitrile).

The number of cells per 25 mm of the elastic layer 122B (number/25 mm) is preferably from 20/25 mm to 80/25 mm, more preferably from 30/25 mm to 80/25 mm, and still more preferably from 30/25 mm to 50/25 mm.

The hardness of the elastic layer 122B is preferably from 100 N to 500 N, and more preferably from 100 N to 400 N, and still more preferably from 150 N to 400 N.

The conductive bearing 123 is a member that rotatably holds the charging member 121 together with the cleaning member 122 such that the distance between the shafts of the members is maintained. The conductive bearing 123 may be formed of any material and may have any shape, as long as the material is conductive. For example, the conductive bearing 123 may be a conductive bearing or a conductive sliding bearing.

The power supply 124 is a device that charges the charging member 121 and the cleaning member 122 to have the same polarity by applying a voltage to the conductive bearing 123. A known high-voltage power supply may be used as the power supply 124.

In the charging device 12 according to the present exemplary embodiment, the power supply 124 applies a voltage to the conductive bearing 123, whereby the charging member 121 and the cleaning member 122 are charged to have the same polarity. As a result, accumulation of a foreign substance (such as toner or an external additive) from the surface of an image holding member on the surface of the cleaning member 122 and the charging member 121 may be suppressed, and the foreign substance may be remained on the image holding member, whereby the foreign substance may be recovered by a cleaning device for the image holding member. Consequently, the accumulation of contaminants on the charging member 121 and the cleaning member 122 may be suppressed and chargeability of the charging member 121 may be maintained over a long period of time.

Image Forming Device and Process Cartridge

The image forming device according to the present exemplary embodiment includes an image holding member; a charging unit that charges the image holding member; a latent image forming unit that forms a latent image on the surface of the charged image holding member; a developing unit that develops the latent image formed on the surface of the image holding member as a toner image using a toner; and a transfer unit that transfers the toner image formed on the surface of the image holding member to a recording medium. The above-described charging device according to the present exemplary embodiment is used as the charging unit (charging device).

The process cartridge according to the present exemplary embodiment may be detachable with respect to the main body of the above-described image forming device, and may include an image holding member and a charging unit that charges the image holding member. The above-described charging device according to the present exemplary embodiment is used as the charging unit. The process cartridge according to the present exemplary embodiment may include, as necessary, at least one of a development unit that develops a latent image formed on the surface of the image holding member as a toner image using a toner, a transfer unit that transfers the toner image formed on the surface of the image holding member to a recording medium, or a cleaning unit that removes a toner remaining on the surface of the image holding member after transfer.

Figure 5:
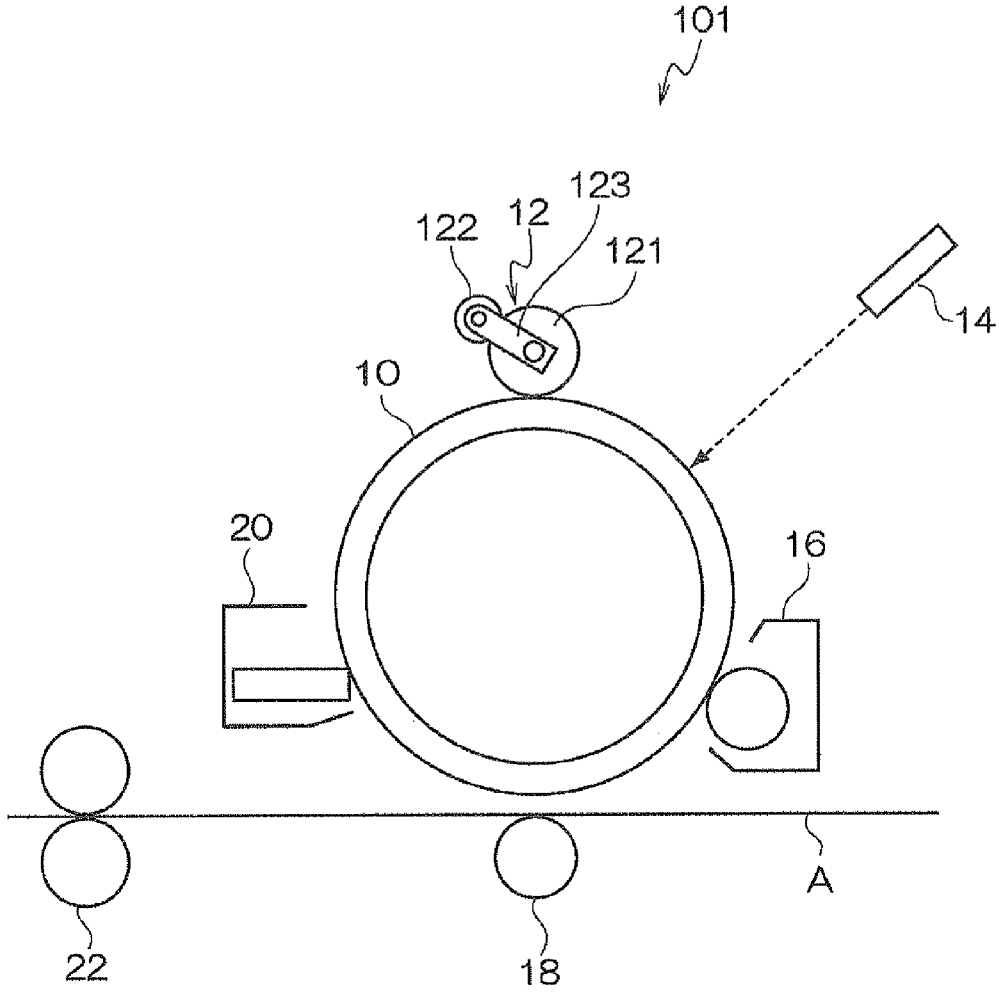
FIG. 5 is a schematic structural view showing an image forming device according to the exemplary embodiment of the present invention.
Figure 6:
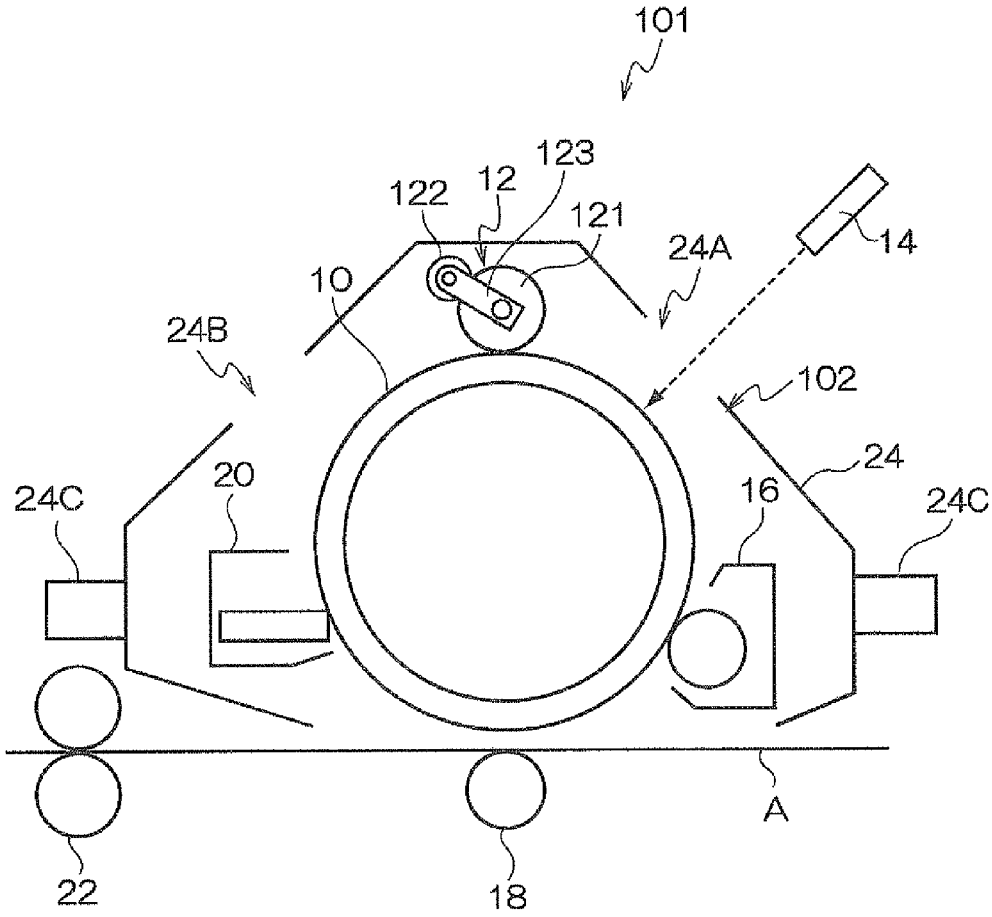
FIG. 6 is a schematic structural view showing a process cartridge according to the exemplary embodiment of the present invention.

Hereinafter, the image forming device and the process cartridge according to the present exemplary embodiment is described with reference to Figures. FIG. 5 is a schematic structural view showing the image forming device according to the present exemplary embodiment. FIG. 6 is a schematic structural view showing the process cartridge according to the present exemplary embodiment.

As shown in FIG. 5, an image forming device 101 according to the present exemplary embodiment includes an image holding member 10. Around the image holding member 10, are arranged a charging device 12 that charges the image holding member 10, an exposure device 14 that exposes the image holding member 10 charged by the charging device 12 to form a latent image, a developing device 16 that develops the latent image formed by the exposure device 14 as a toner image using a toner, a transfer device 18 that transfers the toner image formed by the developing device 16 to a recording medium A, and a cleaning device 20 for removing the toner remaining on the surface of the image holding member 10 after transfer. In addition, the image forming device 101 includes a fixing device 22 that fixes the toner image transferred to the recording medium A by the transfer device 18.

In the image forming device 101 according to the present exemplary embodiment, the charging device according to the present exemplary embodiment is used as the charging device 12, in which, for example, the charging member 121, the cleaning member 122 disposed in contact with the charging member 121, the conductive bearing 123 that holds both of the axial end portions of the charging member 121 and the cleaning member 122 such that each member freely rotates, and the power supply 124 connected to one end of the conductive bearing 123 are provided.

In the image forming device 101 according to the present exemplary embodiment, other than the charging device 12 (charging member 121), a known configuration for an electrophotographic image forming device may be used. Hereinafter, an example of each configuration is described.

Examples of the image holding member 10 includes, but nit limited to, a known photoreceptor, and preferable examples thereof include an organic photoreceptor having a so-called separate function type structure in which a charge generating layer and a charge transporting layer are separated. The image holding member 10 may be a photoreceptor that has a surface layer containing a siloxane resin or a phenol resin having a cross-linking structure and having charge transporting properties.

Examples of the exposure device 14 include a laser optical system and an LED array.

The developing device 16 may be a developing device in which a toner image is formed by bringing a developer holding member, holding a developer layer on the surface thereof, into contact with or adjacent to the image holding member 10, and attaching a toner to a latent image on the surface of the image holding member 10. A developing method used in the developing device 16 is preferably a known method such as a method using a two component developer. Examples of the developing method using a two component developer include a cascade development and a magnetic brush development.

Examples of the transfer device 18 include a non-contact transferring device such as corotron or scorotron, and a contact transferring device that transfers a toner image to the recording medium A by contacting a conductive transfer roller with the image holding member 10 through the recording medium A.

Examples of the cleaning device 20 include a cleaning blade that removes a toner, paper powder or contaminants attached to the surface of the image holding member 10 by directly contacting the cleaning blade with the surface of the image holding member 10. The cleaning device 20 may be a cleaning brush or a cleaning roller.

Preferable examples of the fixing device 22 include a heating fixing device using a heat roller. For example, the heating fixing device includes a fixing roller having a heater lamp for heating in its cylindrical core and, on the outer peripheral surface thereof, having a so-called releasing layer such as a heat resistant resin coating layer or a heat-resistant rubber coating layer, and a pressurizing roller or a pressurizing belt that comes into contact with the fixing roller at a specific contact pressure and has a heat resistant elastic layer formed on the outer peripheral surface of the cylindrical core or the surface of a belt-like base thereof. In a fixing process of an unfixed toner image, the recording medium A to which the unfixed toner image has been transferred is passed between the fixing roller and the pressurizing roller or belt, and the toner image is fixed by thermally melting a binding resin or additives in the toner.

The configuration of the image forming device 101 according to the present exemplary embodiment is not limited to the above-described configuration. For example, the image forming device 101 according to the present exemplary embodiment may be an intermediate transfer type image forming device using an intermediate transfer medium or a tandem-type image forming device in which image forming units that form toner images of each color are arranged in a horizontal direction.

As shown in FIG. 6, the process cartridge according to the present exemplary embodiment is a process cartridge 102 that assembles the image holding member 10, the charging device 12 that charges the image holding member 10, a developing device 16 that develops the latent image formed by the exposure device 14 as a toner image using a toner, and a cleaning device 20 for removing the toner remaining on the surface of the image holding member 10 after transfer in FIG. 5 to integrate, together with a housing 24 having an opening 24A for exposure, and an opening 24B for neutralization exposure by using a mounting rail 24C. The process cartridge 102 is detachable with respect to the main body of the image forming device 101 shown in FIG. 5.

In the above-described image forming device according to the present exemplary embodiment, the conductive member according to the present exemplary embodiment is used as the charging device (as the charging member thereof). However, the conductive member according to the present exemplary embodiment may be used as the transfer device (the as transfer member thereof).

EXAMPLES

Hereinafter, the invention is described in detail with reference to Examples, but the invention is not limited to these examples. In addition, "parts" and "%" are based on weight unless otherwise specified.

Example 1

Production of Charging Roller

Formation of Elastic Layer

To 100 parts of an elastic material (epichlorohydrin-ethylene oxide-allyl glycidyl ether copolymer rubber), 15 parts of a conductive agent (carbon black; trade name: ASAHI THERMAL, manufactured by Asahi Carbon Co., Ltd.), 1 part of a vulcanizing agent (sulfur, 200 mesh, manufactured by Tsurumi Chemical Industry Co., Ltd.), and 2.0 parts of a vulcanization accelerator (trade name: NOCCELER DM, manufactured by Ouchi Shinko Chemical Industrial Co. Ltd.) are added. The mixture is kneaded using an open-roll kneader. Thereafter, using the resultant, a 7 mm-thick elastic layer is formed on the outer peripheral surface of a shaft (conductive support) formed of SUS303 and having a diameter of 8 mm, via an adhesive layer with a press-molding machine, thereby obtaining a roll having a diameter of 15 mm. Subsequently, the roll is polished, thereby obtaining a conductive elastic roll having a diameter of 14 mm and having a 6 mm-thick elastic layer.

Formation of Surface Layer

To 100 parts of a liquid (nylon resin solution; solid content concentration is 8%) in which a nylon resin as a first resin was dissolved in a mixed solution of methanol and 1-butanol (methanol:1-butanol=3:1(weight ratio)), 10 parts of a polyvinyl butyral resin (PVB) as a second resin, 12 parts of carbon black (trade name: MONARCH 880; manufactured by Cabot Corporation) and 2 parts of a curing agent (citric acid) are mixed. The mixture is dispersed using a bead mill and then diluted with methanol, thereby obtaining a dispersion liquid. The surface of the above-obtained conductive elastic roll is coated with the dispersion liquid by immersion, and the roller is dried by heating at 160° C. for 20 minutes, thereby forming a 10 μm-thick surface layer. The details of the materials used are shown in Table 1.

In this manner, a charging roll is obtained.

Examples 2 to 6 and Comparative Examples 1 and 2

Each of charging rollers of Examples 2 to 6 and Comparative Examples 1 and 2 is obtained in a manner similar to Example 1, except that the first resin, the second resin and the carbon black are changed as shown in Table 1.

Evaluation of Charging Roller

Properties of Surface Layer

As described above, under a transmission electron microscope (TEM), the presence of the sea/island structure, the diameter of the island portion, the proportion of carbon black included in the island portion with respect to a total amount of carbon black contained in the surface layer ("CB proportion in island portion" in Table 1), and the presence of the carbon black that is unevenly distributed in the island portion with a higher concentration at the side of the interface between the island portion and the sea portion ("uneven distribution of CB" in Table 1) are observed. The results are shown in Table 1.

Figure 7:
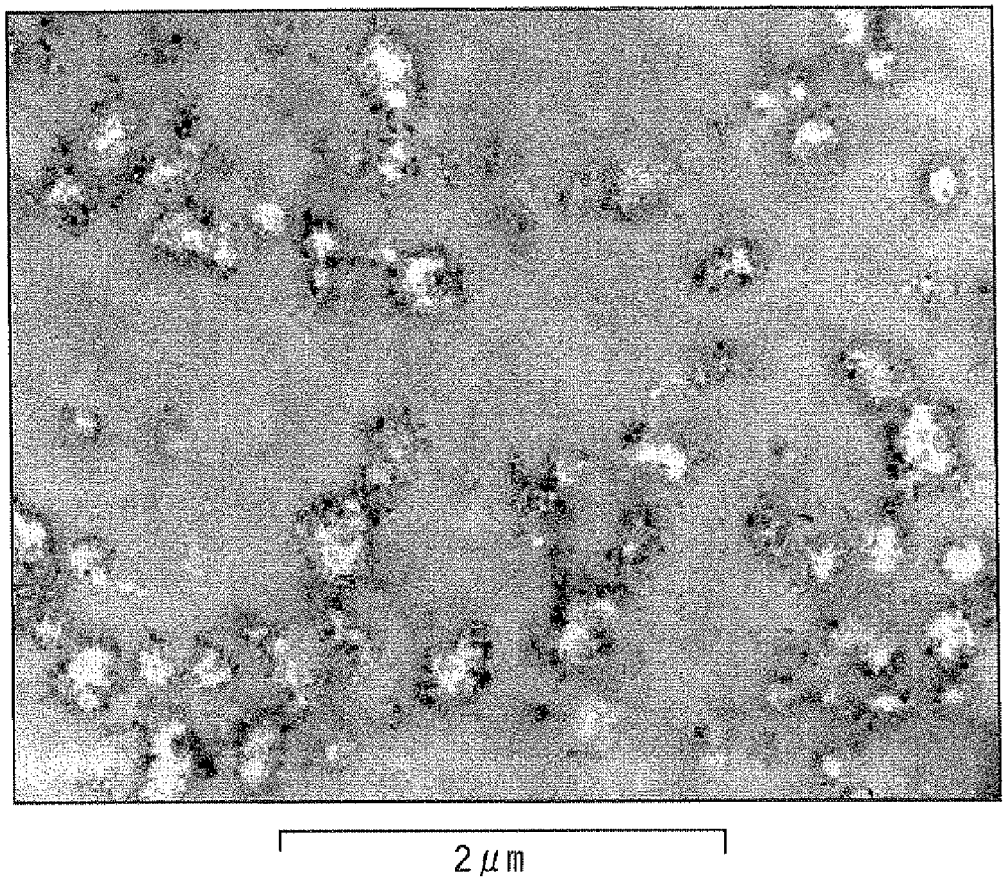
FIG. 7 shows a photograph of a transmission electron microscope (TEM) of a surface layer of a charging roller prepared in Example 1.

FIG. 7 shows a photograph of a transmission electron microscope (TEM) of the surface layer of the charging roller produced in Example 1. In the TEM photograph of FIG. 7, whitish discontinuous-phase regions represent the island portion and black dot-like regions represent the carbon black.

FIG. 7 shows that, in the surface layer of the charging roller, the carbon black is included in the island portion, and, in the island portion, the carbon black is unevenly distributed with a higher concentration at the side of the interface between the island portion and the sea portion.

Evaluation of Charging Properties

The obtained charging roll is set in a process cartridge of a color copying machine DOCUCENTRE COLOR a450 (trade name; manufactured by Fuji Xerox Co., Ltd.), and a half tone image (image concentration of 50%) is formed while changing current values as shown in Table 2, under the conditions of a temperature of 10° C. and a humidity of 15%. The image is evaluated in accordance with the following criteria. The results are shown in Table 2.

Evaluation Criteria

A: White patches caused by uneven charging of a charging roller is not observed

B: 10 or less white patches caused by uneven charging of a charging roller are observed C: more than 10 to 30 or less white patches caused by uneven charging of a charging roller are observed D: more than 30 white patches caused by uneven charging of a charging roller are observed

TABLE 1

| | First resin (Resin constituting sea portion) | | Second resin (Resin constituting island portion) | | | Carbon black | | |
|---|---|---|---|---|---|---|---|---|
| | Type | SP value | Type | SP value | Addition amount (parts) | Type | DBP oil absorption amount (cc/100 g) | Addition amount (parts) |
| Ex. 1 | Nylon | 13.2 | PVB | 19.4 | 10 | MONARCH 880 | 110 | 13 |
| Ex. 2 | Nylon | 13.2 | Polystyrene | 9.12 | 10 | MONARCH 880 | 110 | 13 |
| Ex. 3 | Nylon | 13.2 | Polystyrene | 9.12 | 15 | MONARCH 880 | 110 | 13 |
| Ex. 4 | Nylon | 13.2 | Polystyrene | 9.12 | 5 | MONARCH 880 | 110 | 13 |
| Ex. 5 | Nylon | 13.2 | Polystyrene | 9.12 | 10 | PRINTEX 150 | 150 | 12 |
| Ex. 6 | Nylon | 13.2 | Polystyrene | 9.12 | 10 | REAGAL 400R | 70 | 15 |
| Comp. Ex. 1 | Nylon | 13.2 | — | — | — | MONARCH 880 | 110 | 18 |
| Comp. Ex. 2 | Nylon | 13.2 | PVA | 14.2 | 10 | MONARCH 880 | 110 | 18 |

| | Sea/island structure | Diameter of island portion (nm) | CB proportion in island portion (%) | Uneven distribution of CB |
|---|---|---|---|---|
| Ex. 1 | Present | 350 | 95 | Present |
| Ex. 2 | Present | 400 | 90 | Present |
| Ex. 3 | Present | 500 | 96 | Present |
| Ex. 4 | Present | 250 | 88 | Present |
| Ex. 5 | Present | 400 | 93 | Present |
| Ex. 6 | Present | 400 | 90 | Present |

TABLE 1-continued

| | | | | |
|---|---|---|---|---|
| Comp. Ex. 1 | Absent | 0 | — | — |
| Comp. Ex. 2 | Absent | 0 | — | — |

Nylon: N-methoxymethylated nylon (trade name: FR101, manufactured by Namariichi Co., Ltd.)
PVB (polyvinylbutyral): (trade name: DENKA BUTYRAL, manufactured by Denki Kagaku Kogyo Co., Ltd.)
Polystyrene: (trade name: STYRENE MONOMER, manufactured by Sunright, Inc.)
PVA (polyvinyl alcohol): (trade name: DENKA POVAL K-24E, manufactured by Denki Kagaku Kogyo Co., Ltd.)
MONARCH 880 (trade name), manufactured by Cabot Corporation
PRINTEX 150 (trade name), manufactured by Degussa
REGAL 400R (trade name), manufactured by Cabot Corporation

TABLE 2

| Evaluation of charging properties (Occurrence of white patch) | | | | | |
|---|---|---|---|---|---|
| | Current Value (mA) | | | | |
| | 130 | 135 | 140 | 145 | 150 |
| Ex. 1 | C | B | A | A | A |
| Ex. 2 | D | C | B | A | A |
| Ex. 3 | D | C | C | B | B |
| Ex. 4 | D | C | B | B | A |
| Ex. 5 | D | C | C | B | B |
| Ex. 6 | D | C | C | B | A |
| Comp. Ex. 1 | D | D | D | D | C |
| Comp. Ex. 2 | D | D | D | D | D |

As shown in Tables 1 and 2, in the Examples, uneven discharge is suppressed even when the current value is small and occurrence of white patches caused by uneven discharge is suppressed, as compared with the Comparative Example.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive member comprising:
a substrate;
an elastic layer provided on the substrate; and
a surface layer provided on the elastic layer,
the surface layer having a sea/island structure including a sea portion containing a first resin and an island portion containing a second resin, and at least the island portion containing carbon black,
wherein an amount of the carbon black in the island portion is 90% or more with respect to a total amount of carbon black in the surface layer.

2. The conductive member according to claim 1, wherein a diameter of the island portion is from about 100 nm to about 500 nm.

3. The conductive member according to claim 1, wherein the carbon black in the island portion is distributed with a higher concentration at a side of an interface between the island portion and the sea portion.

4. The conductive member according to claim 1, wherein a difference of SP values of the first resin and the second resin is from about 2 to about 10.

5. A charging device comprising the conductive member according to claim 1.

6. A process cartridge comprising:
an image holding member; and
a charging unit that charges the image holding member,
the charging unit including the charging device according to claim 5.

7. An image forming device comprising:
an image holding member;
a charging unit that charges the image holding member;
a latent image forming unit that forms a latent image on a surface of the charged image holding member;
a developing unit that develops the latent image formed on the surface of the image holding member as a toner image using a toner; and
a transfer unit that transfers the toner image formed on a surface of the image holding member to a recording medium,
the charging unit including the charging device according to claim 5.

8. The conductive member according to claim 1, wherein a ratio of the amount of carbon black included in the island portion within 50 nm from an interface of the island portion and the sea portion to the total amount of carbon black included in the island portion is 90% or more.

9. A conductive roll member comprising:
a shaft;
an elastic layer provided on the shaft; and
a surface layer provided on the elastic layer, the surface layer having a sea/island structure including a sea portion containing a first resin and an island portion containing a second resin, and at least the island portion containing carbon black,
wherein an amount of the carbon black in the island portion is 90% or more, with respect to a total amount of carbon black in the surface layer.

10. The conductive roll member according to claim 9, wherein a diameter of the island portion is from about 100 nm to about 500 nm.

11. The conductive roll member according to claim 9, wherein the carbon black in the island portion is distributed with a higher concentration at a side of an interface between the island portion and the sea portion.

12. The conductive roll member according to claim 9, wherein a difference of SP values of the first resin and the second resin is from about 2 to about 10.

13. A charging device comprising the conductive roll member according to claim 9.

14. A process cartridge comprising:
an image holding member; and
a charging unit that charges the image holding member,
the charging unit including the charging device according to claim 13.

15. An image forming device comprising:
an image holding member;
a charging unit that charges the image holding member;

a latent image forming unit that forms a latent image on a surface of the charged image holding member;

a developing unit that develops the latent image formed on the surface of the image holding member as a toner image using a toner; and a transfer unit that transfers the toner image formed on a surface of the image holding member to a recording medium, the charging unit including the charging device according to claim 13.

16. The conductive roll member according to claim 9, wherein a ratio of the amount of carbon black included in the island portion within 50 nm from an interface of the island portion and the sea portion to the total amount of carbon black included in the island portion is 90% or more.

* * * * *